United States Patent [19]

Antonuzzi et al.

[11] Patent Number: 4,595,808

[45] Date of Patent: Jun. 17, 1986

[54] ELECTROMECHANICAL SWITCH

[75] Inventors: Anthony P. Antonuzzi, Stoneham; Donald J. Carignan, Chelmsford, both of Mass.

[73] Assignee: The United States of America as represented by the Secretary of the Air Force, Washington, D.C.

[21] Appl. No.: 647,781

[22] Filed: Sep. 6, 1984

[51] Int. Cl.[4] ..... H01H 43/60; F42C 15/40

[52] U.S. Cl. ..... 200/37 R; 102/264; 307/116

[58] Field of Search ..... 200/11, 14, 17, 18, 200/33-38; 307/112, 116; 235/128-132; 102/221, 228, 262, 264, 268

[56] References Cited

U.S. PATENT DOCUMENTS

| | | | |
|---|---|---|---|
| 2,799,740 | 7/1957 | Blackman | 200/14 |
| 3,924,233 | 12/1975 | Nastronero et al. | 343/6 R |
| 4,045,627 | 8/1977 | Kitai et al. | 200/37 R |
| 4,135,452 | 1/1979 | Kinsey et al. | 102/214 |
| 4,168,663 | 9/1979 | Kohler | 102/214 |
| 4,193,072 | 3/1980 | McKusick | 343/6 ND |
| 4,197,436 | 4/1980 | Ishikawa et al. | 200/38 R X |

*Primary Examiner*—J. R. Scott

*Attorney, Agent, or Firm*—Donald J. Singer; Stanton E. Collier

[57] ABSTRACT

A hardened electromechanical switch is disclosed. When appropriate electrical contacts and pick-offs are aligned, four switches close. The possible number of switch combinations selectable are 4095 based upon a base eight counting system. The switch has a counter section and a memory section. The counter section uses an odometer like device based upon octal. Each counter wheel of the counter section has an electrical pick-off that interacts with the memory section. In the memory section, a plurality of octal numbers, four, are entered into and locked thereon such that each counter set disk, four, therein has one octal number thereon. Electrical contacts are placed on the counter set disks of the memory section and these touch the pick-offs of the counter wheels which will simultaneously close on the four contacts of the counter set disk in only one of the 4095 combinations noted above.

8 Claims, 17 Drawing Figures

FIG. 5
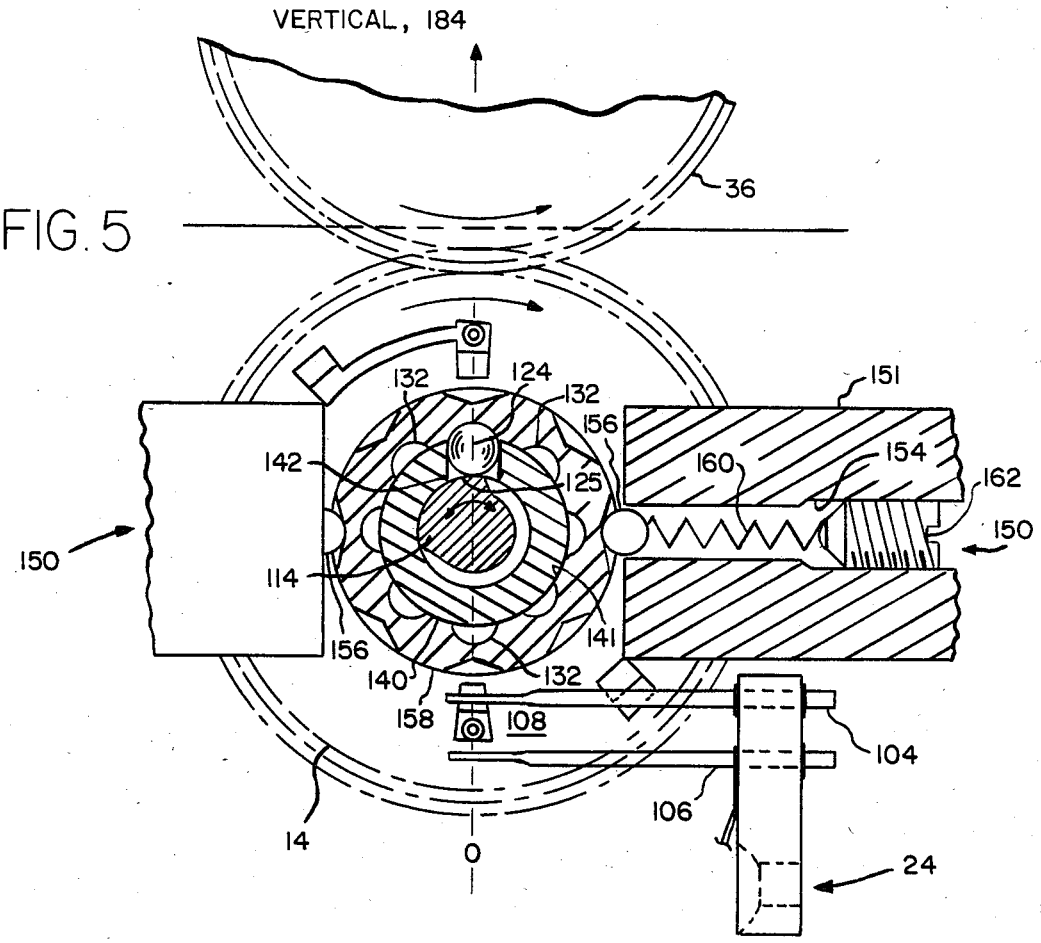
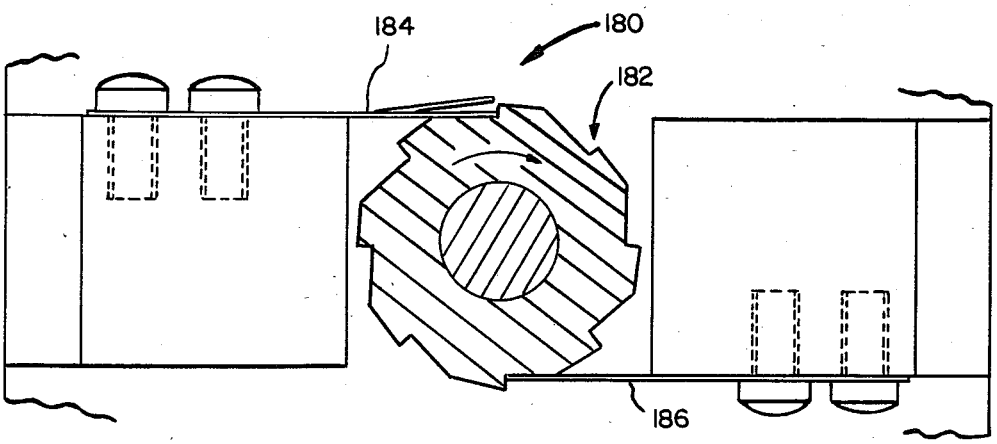
FIG. 6

ELECTROMECHANICAL SWITCH

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to electromechanical switches, and, in particular, relates to switches useable in ordnance fuzing and safing devices.

In detonating a modern ordnance, one can select a plurality of conditions that must occur before the device is triggered to explode. These conditions can be selected in advance and stored in a "memory" device and then connected to external and internal conditions occurring such as contact with a target, rate of spin, height above ground zero, distance to a flying target, time of flight, etc. Once a particular condition is determined to be of importance it must be entered into a memory device and retained therein under the most unfavorable conditions.

One device capable of storing data is a typical IC memory device. Although data can be entered very fast, the IC is very susceptible to damage from ionizing radiation from either hostile, friendly, or natural sources.

The data can also be stored in a combination of latching relays. If the number to be stored consists of two to four thousand increments then one is required to use about 10 to 12 relays. Obviously, the more relays used, the lower the reliability. In addition, the latching relays must be carefully balanced dynamically to prevent the transfer of switch elements during, for example, missile flight. Other undesireable changes may occur during environment encounters.

The present invention is directed towards providing an electromechanical switch with a hardened memory in which these undesirable characteristics are minimized.

SUMMARY OF THE INVENTION

The instant invention sets forth an electromechanical switch used in ordnance having a hardened memory and thus thereby overcoming the problems set forth hereinabove.

The present invention provides an electromechanical switch that electrically closes, for a brief moment of time, after a given predetermined interval of time. This output signal can be used to detonate an ordnance in accordance with a selected scheme.

Initially, a four digit octal number is set in a memory section. Each octal digit of the number is associated with one of four set disks and the position of that disk is further associated with the digit set therein. A counter section meshes both mechanically and electrically with the memory section to cause the switch to close.

In the memory section, brush type reading means are used to monitor the position of each set disk during the process of putting the number thereon. Each set disk has, for example, eight octal digits encoded thereon: each located 45 degrees from the adjacent and each encoded onto each position to be read by the brush type reading means.

To set the first selected octal digit, the reading means determines the octal digit in a read head. A stepper motor selectively increments the first set disk until the first selected octal digit is in the read head, for example. The second selected octal digit is then set on the second set disk in a like manner and so on until all four octal digits are stored in the four set disks which are then mechanically held in position after the numbers are stored thereon and while other set disks are being positioned to store other numbers thereon. The act of storing is correlated with the angle of rotation of the set disk.

Each set disk having spur gears about its circumference is engaged with a single counter set disk that has a single electrical contact thereon. The position of the contact relates to the selected octal digit stored in the set disk. Neither disk rotates after being loaded. Each counter set disk with a contact is considered to be an electrical output. The angular positions of the contact define a plurality of positions available. One position is preselected to correspond with an octal digit.

The counter section has a timing drive that rotates at a given frequency. The drive turns a modified geneva mechanism similar to an odometer except octal is used. One full rotation of a first counter wheel causes one-eighth revolution of a second counter wheel. One full rotation of the second counter wheel causes one-eighth revolution of a third counter wheel, and similarly to a fourth counter wheel. Each counter wheel has an electrical pick-off that comes into passing contact with each revolution with the electrical contact of one of the counter set disks. The counter wheels and counter set disks are co-axial and placed in a staggered manner. Thus the first counter wheel will electrically close as a switch when its electrical pick-off touches the electrical contact of the stationary first counter set disk. This also occurs for each other set of counter wheel/stationary counter set disk. Only when all pick-offs and contacts are closed together does a trigger signal pass through the switch. Each electrical pick-off moves through a fixed number of positions. Each position of the pick-off can be considered a unique output from the counter section. The number of pick-off positions per output being equal to the counting base of the counter and each position is considered to be an electrical output of that counter wheel.

One object of the present invention is to provide an electromechanical switch that is hardened.

Another object of the present invention is to provide an electromechanical switch capable of delayed closing.

Another object of the present invention is to provide an electromechanical switch having proven high reliability items used therein.

Another object of the present invention is to provide an electomechanical switch having a mechanical counter which has increments separated by 45° of rotation to provide high resolution.

These and many other objects and advantages of the present invention will be readily apparent to one skilled in the pertinent art from the following detailed description of a preferred embodiment of the invention and the related drawings.

BRIEF DESCRIPTION OF THE DRAWINGS

FIG. 5 illustrates by partial cross section the set disk, drive cylinder, and select shaft of the electromechanical switch of the present invention;

FIG. 6 illustrates by cross section a pawl mechanism to allow the drive cylinder to rotate in one direction only;

DETAILED DESCRIPTION OF THE PREFERRED EMBODIMENT

Figure 1:
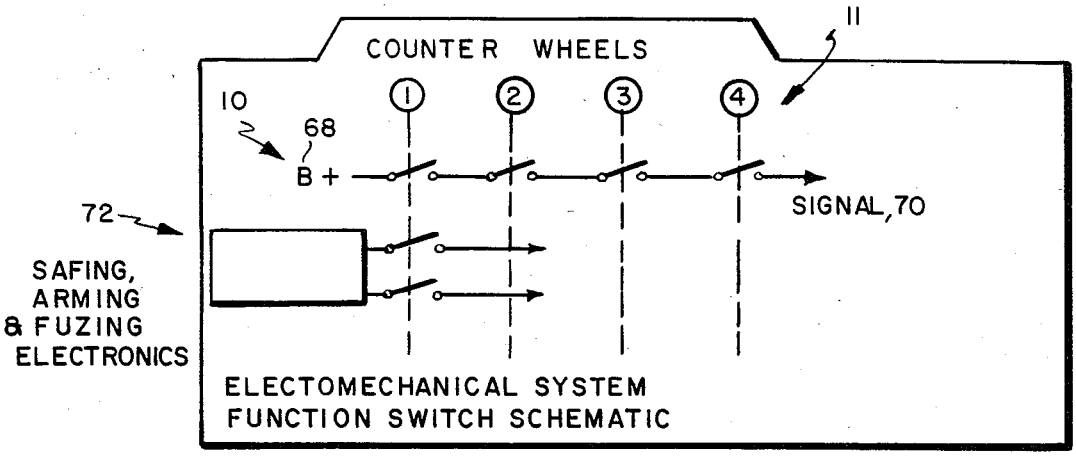
FIG. 1 by schematic illustrates a switching scheme of the present invention.

Referring to FIG. 1, a schematic of an electromechanical switch 10 is shown. A B+ voltage 68 is input to switch 10 and will be output if and only if all sequential switches 11, four in this embodiment, are closed at the same time. Further, an output signal 70 must occur along with other safing, arming and fuzing signals 72 to initiate detonation. These signals 70 and 72 are input into, for example, an AND gate to give a trigger signal.

Figure 2:
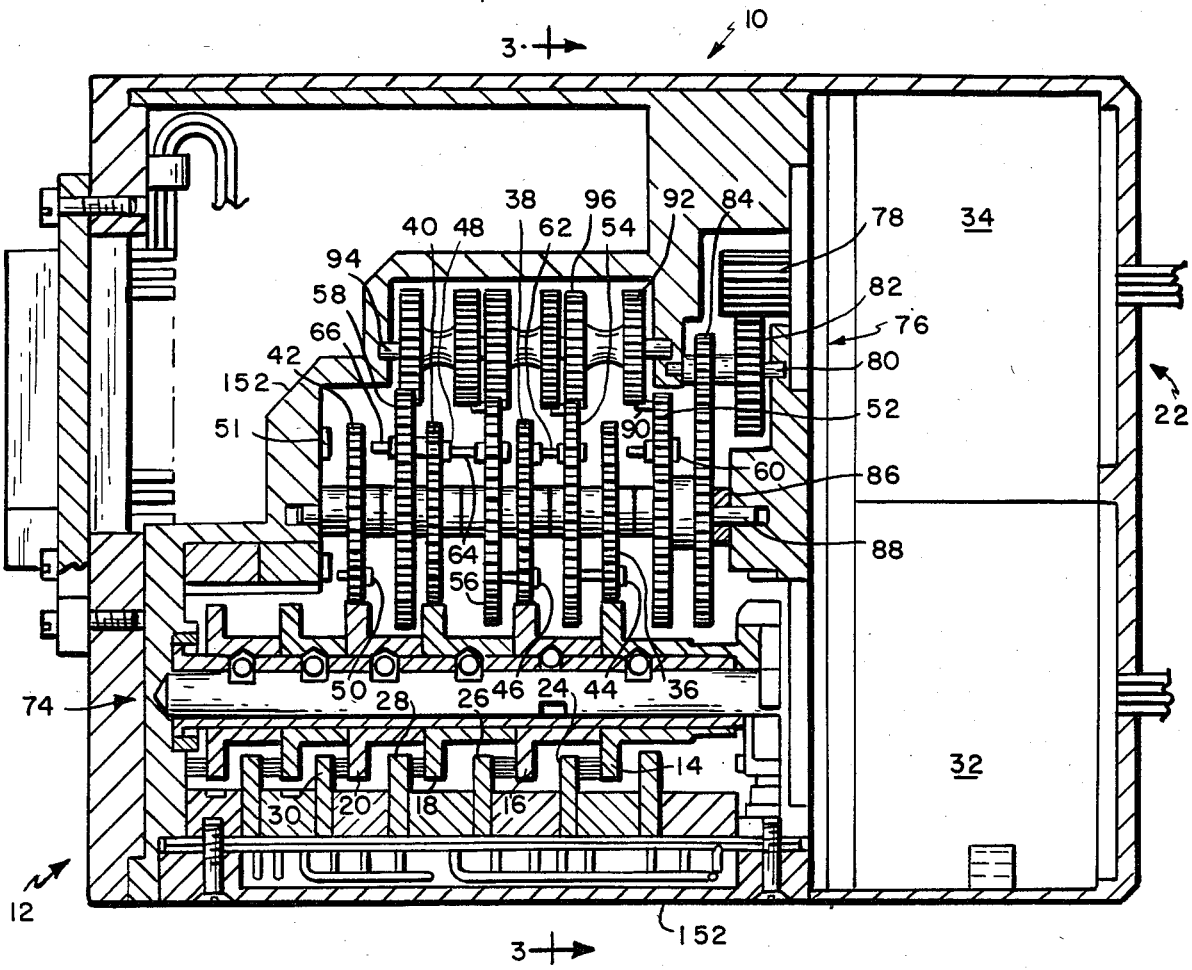
FIG. 2 illustrates by side view cross section the electromechanical switch of the present invention.

FIG. 2 illustrates by partial cross section the electrical and mechanical devices needed to accomplish the objectives of making a hardened memory device. Electromechanical switch 10 has a counter section 22 and a memory section 12 that cooperatively establish the sequential switches 11 noted hereinabove and to be explained hereinbelow.

Memory section 12 has four set disks 14, 16, 18 and 20, a set/lock means 74, four reading heads 24, 26, 28 and 30, four counter set disks 36, 38, 40 and 42 geared to the four set disks 14, 16, 18 and 20, and electrical contacts 44, 46, 48 and 50 attached to counter set disks 36 to 42.

Counter section 22 has a timing drive 34 rotating a modified geneva drive 76 at a fixed frequency. A part thereof being four counter wheels 52, 54, 56 and 58 that have thereon electrical pick-offs 60, 62, 64 and 66 that selectively contact electrical contacts 44, 46, 48 and 50. Electrical pick-offs 60 to 66 rotate through 4095 positions before an electrical short is formed with contacts 44 to 50 to act as the sequential switches 11 noted above.

The memory and counter sections 12 and 22 are held within in a metal housing 152 having appropriate electrical inputs and outputs for reading heads 24 to 30 to communicate with a computer, not shown, electrical power and controls to a stepper motor 32 of memory section 12 and a timing driver 34 of counter section 22, and switch leads, not shown. Other devices can be located therein but for the purpose of this invention these need not be discussed because they are not essential to the operation of switch 10.

Counter section 22 has therein modified geneva drive 76 that operates essentially like a car odometer drive excepting that counter section 22 uses a base 8 system instead of a base 10. Other bases are clearly possible.

Figure 3:
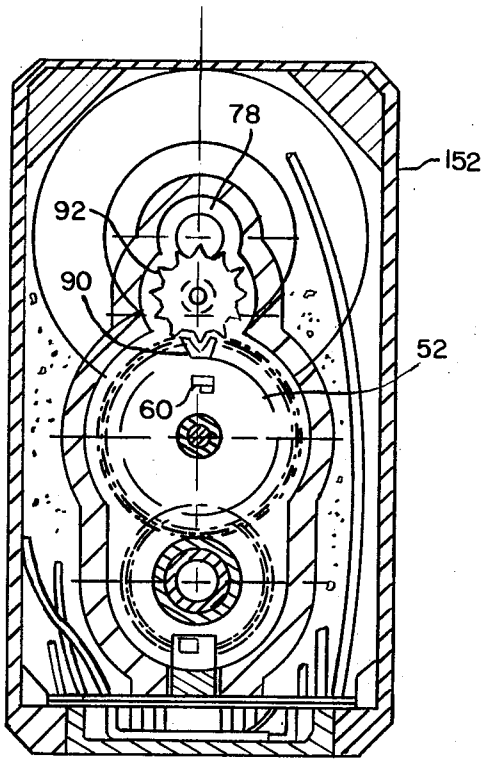
FIG. 3 illustrates by a front view cross section the electromechanical switch of FIG. 2 of the present invention.

Timing drive 34 drives a pinion gear 78 that meshes with a first axle 80 having two spur gears 82 and 84. Gear 84 meshes with a gear 86 that rotates freely about a second axle 88. Gear 86 is in locked engagement with first counter wheel 52 that rotates constantly and freely about second axle 88. An electrically isolated path, not shown, is provided to pick-off 60 which is insulated from first counter wheel 52 by conventional means. Attached to the circumference of first counter wheel 52, being the geneva driver, is a first segment gear 90, shown also in FIG. 3, which causes intermittent rotation to a first driven wheel 92 freely attached to a third axle 94. First driven wheel 92 is in locked engagement with a spur gear 96 that drives second counter wheel 54.

As noted above, octal 8 is used in the present invention wherein 8 complete rotations of first counter wheel 52 causes one complete rotation of second counter wheel 54. Each rotation of similar gearing arrangements cause a second counter wheel 54 to rotate 8 times before third counter wheel 56 rotates one full revolution, and also, third counter wheel 56 must rotate 8 times before fourth counter wheel 58 rotates one full rotation. Counter wheels 52, 54, 56 and 58 rotate freely about second axle 88.

Pick-offs 60, 62, 64 and 66 being attached to counter wheels 52, 54, 56 and 58, respectively, move through $(8^4-1)$ position combinations before repeating themselves as determined by $(B^N-1)$, B being the counting base and N being the number of counter wheels.

Returning to FIG. 2, the four octal digits are placed in memory section 12 as noted herein below. Set disks 14, 16, 18 and 20 are geared directly to counter set disks 36, 38, 40 and which rotate on second axle 88. Counter set disks 36, 38, 40 and 42 are locked at fixed angular positions on axle 88 once the four octal digits are placed on set disks 14, 16, 18 and 20 by set/lock means 74.

As shown in FIG. 2, contacts 44, 46, 48 and 50 are mounted onto counter set disks 36, 38, 40 and 42 respectively. These contacts are designed such that there is constantly an electrical path between contact 44 of first counter set disk 36 and second counter wheel 54 and pick-off 62 therein; between contact 46 of second counter set disk 38 and pick-off 64 of counter wheel 56; and between contact 48 of third counter set disk 40 and pick-off 66 of counter wheel 58.

When pick-off 86 of counter wheel 52 touches contact 44, pick-off 62 of counter wheel 54 touches contact 46, pick-off 64 touches contact 48, and pick-off 66 touches contact 50, an electrical path is established between pick-off 86 and contact 50 thus closing briefly sequential switches 11 shown in FIG. 1. Electrical power is suppled to pick-off 60 by conventional means such as brushes, not shown. Contact 50 of counter set disk 42 is always in electrical contact with a circular conducting ring 51 which is a part of the output circuit.

Figure 8A:
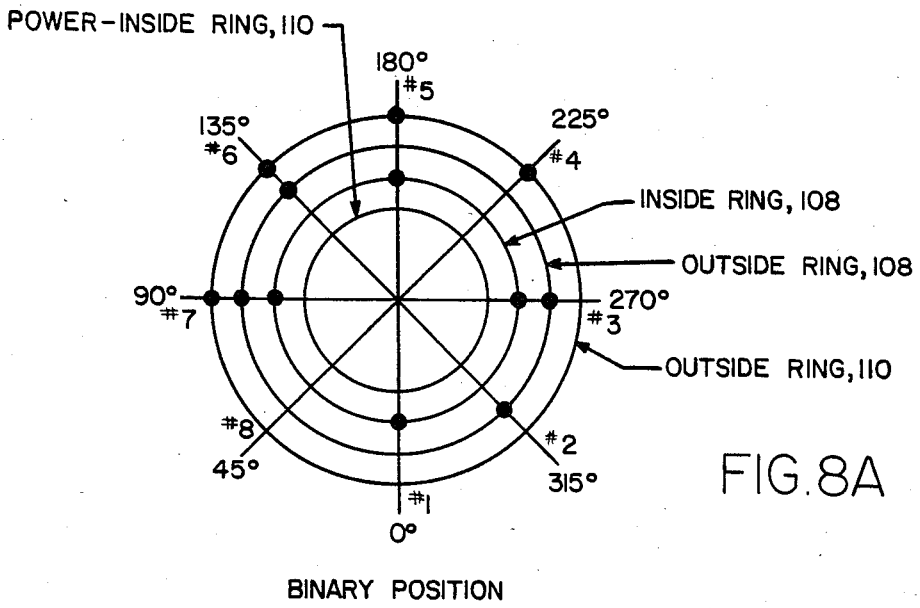
FIGS. 8A to 8C illustrate means for determining position of the set disks of the present invention.

As noted above, an octal digit, 0 to 7, is encoded on each of four set disks 14, 16, 18 and 20. FIG. 8A shows the position of each octal digit represented in binary and the position of each on each set disk.

Figure 4:
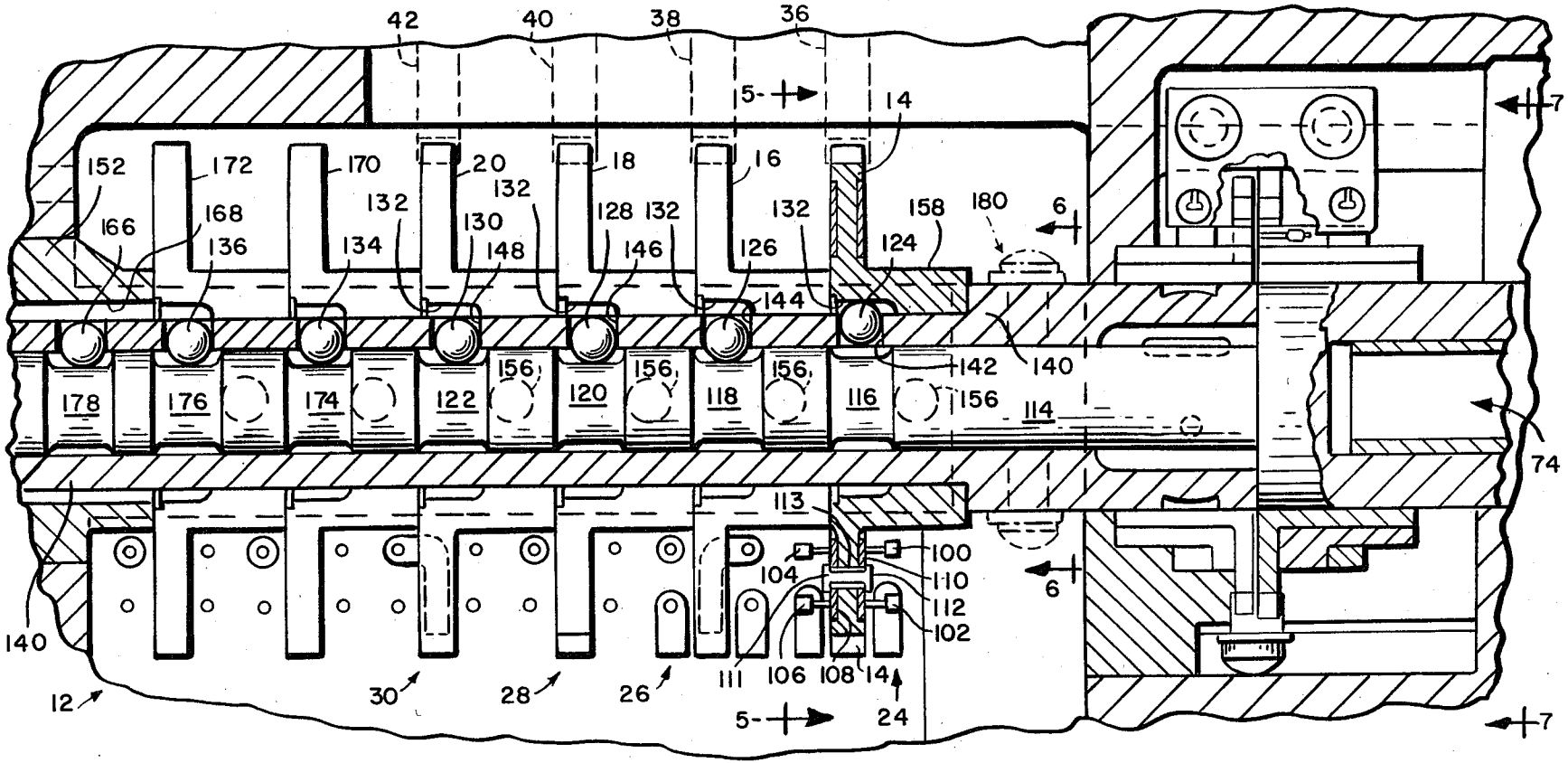
FIG. 4 illustrates by partial cross section the memory means of the present invention.
Figure 7:
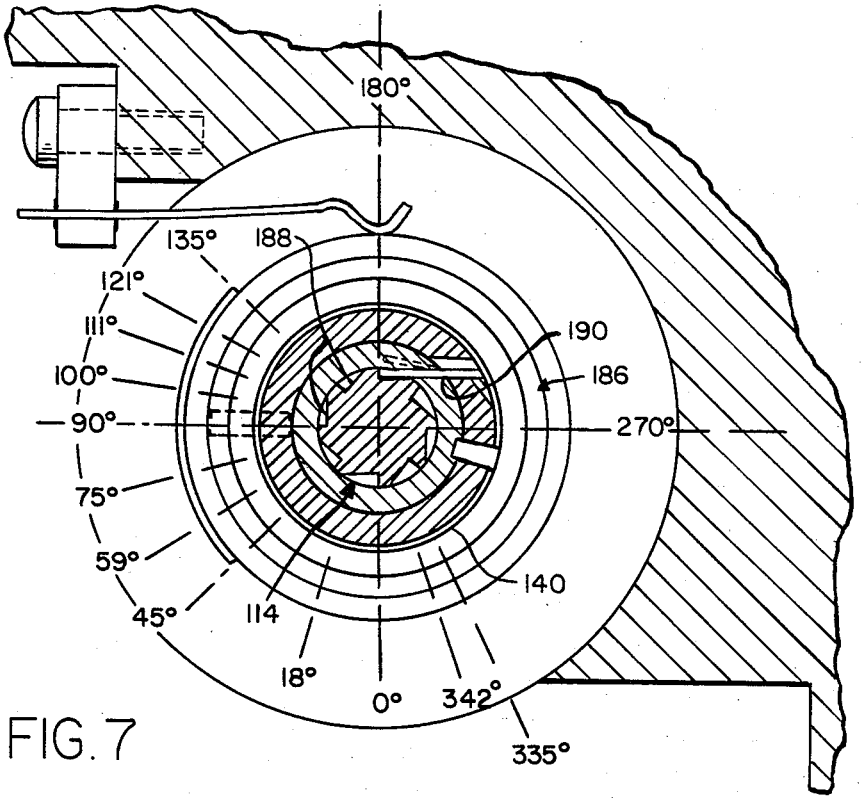
FIG. 7 illustrates by cross section an end view of the ratchet drive connected to memory means of FIG. 4.
Figure 8B:
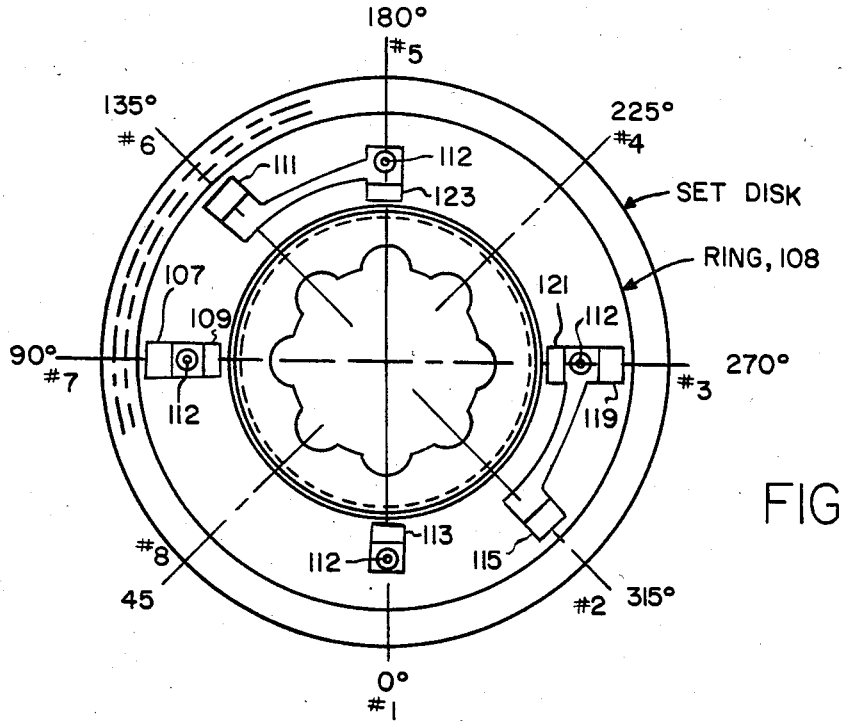
Figure 8C:
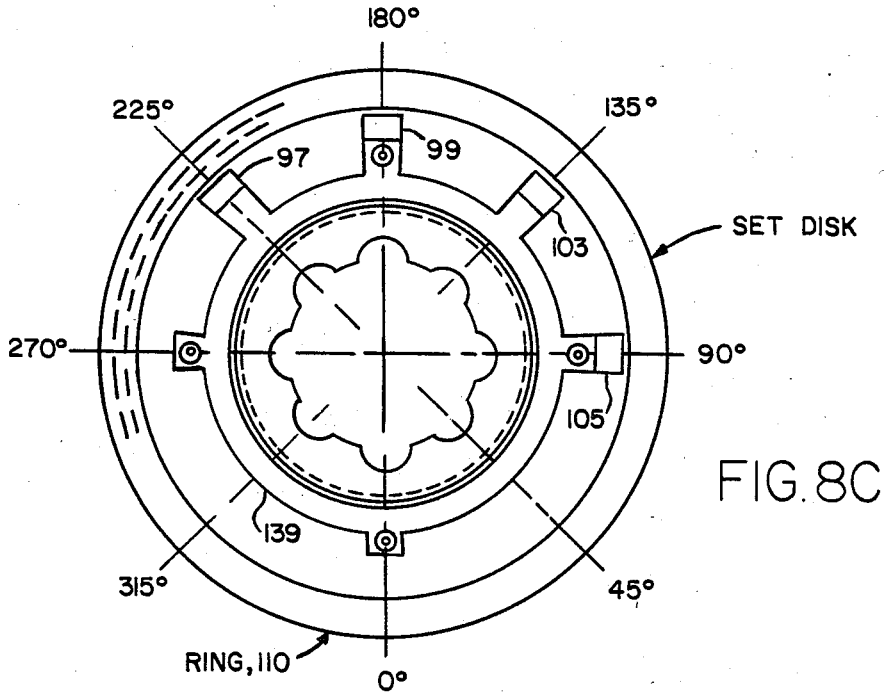

In order to read the encoded digits, read head 24, FIG. 4, has four read brushes 100, 102, 104 and 106 that contact two printed circuit board donut shaped rings 108 and 110 as shown in FIGS. 8B and 8C that are attached to set disk 14 on opposite sides as illustrated in FIG. 4. A power connecting pin 112 transfers, appropriately, power between the two rings 108 and 110. Pin 12 is made of an insulating sleeve 113 with through contact 111 therein. If pin 112 was in contact with metal set disk 14, false readings would be put on all pins 112 thereon. Obviously, other arrangements can be used to determine the position of each set disk 14 to 20.

Referring to FIG. 8B, this illustrates ring 108. Electrically conductive lands 107 to 123 are areas where brushes 104 and 106 touch as set disk 14 rotates. In FIG. 8C brushes 100 and 102 touch lands 97 to 105. Power is applied by brush 100 to ring 110 on the conductive continuous area 139. At the 270 degree location, for example, brush 100 has power, brush 102 is open, and on ring 108, brush 104 and 106 both have power thereon. The following table provides greater detail as to reading the position of the set disks and the octal digit encoded thereon.

TABLE I

| OCTAL | BRUSH 104 | BRUSH 106 | BRUSH 102 |
|---|---|---|---|
| 0 | 0 | 0 | 0 |
| 1 | 1 | 0 | 0 |
| 2 | 0 | 1 | 0 |
| 3 | 1 | 1 | 0 |
| 4 | 0 | 0 | 1 |
| 5 | 1 | 0 | 1 |
| 6 | 0 | 1 | 1 |
| 7 | 1 | 1 | 1 |

1 represents continuity

Each of the set disks 14, 16, 18 and 20 have identical read heads 24 and rings 108 and 110 mounted thereon. A computer, not shown, receives data from read heads 24, 26, 28 and 30 to determine what octal digits are presently loaded on each of the set disks which depends on the angular positions of each set disk 14 to 20 in read heads 24 to 28.

For example, when the first octal digit is placed on set disk 14, the computer reads what digit is in read head 24. If the correct digit is not present, the computer will command stepper motor 32 to sequence to unlock set disk 14, move set disk 14 to the proper position, i.e., proper octal digit, and lock set disk 14. This is repeated for each of the other three disks 16, 18 and 20.

In describing the preferred embodiment, only four set disks 14, 16, 18 and 20 are considered but others are available for additional encoding.

FIG. 4 illustrates by partial cross section set/lock means 74. FIGS. 5, 6, 7 and 9 further illustrate set/lock means 74. Set/lock means 74 includes a select shaft 114, a drive cylinder 140, a pawl means 180, detent means 150, a ratchet drive 186, and stepper motor 32.

In FIG. 4, select shaft 114 of set/lock means 74 has a plurality of cams 116, 118, 120, 122, 174, 176 and 178 in particular, which are further shown in FIGS. 9A to 9G. In particular, cams 116 to 122 selectively move outwardly spheres 124, 126, 128 and 130 into set disk pockets 132, see FIG. 5. Select shaft 114 rotates within drive cylinder 140 having holes 142, 144, 146 and 148, into which spheres 124 to 130 radially move upon force applied by lobes 125, 127, 129 and 131 of cams 116, 118, 120 and 122, respectively.

Drive cylinder 140 is locked to housing 152 when a locking ball 166 is cammed up into a housing pocket 168. Also when this occurs all spheres are cammed up into their respective pockets so that set disks 14 to 20 are locked on drive cylinder 140.

As shown in FIG. 4, sphere 124 has been pushed by lobe 125 of cam 116 up into pocket 132 of set disk 14. The other spheres have not been moved. Upon rotation of drive cylinder 140, only set disk 14 moves. The other set disks 16, 18 and 20 remain held in position by a detent means 150 shown in FIG. 5 which is a view of first set disk 14. Each set disk 14 to 20 has detent means 150 therein to hold set disks while one of the other set disks is being rotated to set the octal digit therein.

Detent means 150 includes a housing 151 with a hole 154 therethrough. A detent ball 156 is held against a star shaped hub 158 of disk 14 by a spring 160 and a set screw 162 inserted within hole 154. Two detent means 150 are shown in FIG. 5 to provide adequate holding force against rotation of set disk 14. Further adjustment is allowed by moving set screw 162 against spring 160. When the sphere is cammed up into the set disk pocket, the force of drive cylinder 140 turning overcomes the force of detent means 150.

Each set disk 14 to 20 has eight pockets 132 therein as shown in FIG. 5 for set disk 14. Each pocket 132 is located 45 degrees from the adjacent pocket 132 and are located on an inside surface 141 of set disk 14. Set disks 170 and 172 can be used for additional encoding but are not included.

Referring to FIG. 5, select shaft 114 is shown inside of drive cylinder 140. Drive cylinder 140 has one hole 142 therethrough for holding sphere 124.

Stepper motor 32 rotates select shaft 114 either in a clockwise (CW) or in a counter clockwise direction (CCW). Drive cylinder 140 rotates only in a clockwise direction and is driven by select shaft 114 when any of spheres 124 to 136 are cammed up into any of pockets 132. Select shaft 114 rotates driver cylinder 140 only in a CW direction by means of a ratchet driver 186 shown in FIG. 7. Stepper motor 32 rotates shaft 114 either CW or CCW. CCW rotation of shaft 114 rotates only shaft 114. But due to ratchet drive 186, CW rotation of shaft 114 causes drive cylinder 140 to rotate CW also. Shaft 114 has eight ratchet teeth 188 and a pawl 190 engages teeth 188 only when shaft 114 is rotated CW. Since pawl 190 is bolted to drive cylinder 140 in a CW manner rotation of shaft 114 in a CCW manner causes pawl 190 to skip over teeth 188.

Referring to FIG. 6, a pawl means 180 prevents the CCW rotation of drive cylinder 140 by having ratchet teeth 182 thereon. Two pawls 184 and 186 insure CW rotation by interaction with ratchet teeth 182.

In order to understand the interaction between select shaft 114, spheres 124 to 136, locking ball 166, drive cylinder 140, and set disks 14 to 20 refer to FIGS. 9A to 9G where cross sections of all cams 116 to 122 and 174 to 178 are shown relative to a vertical direction 184 as defined in FIG. 5 when sphere 124 is cammed up. If one compares the position of shaft 114 in FIG. 9A to that of FIG. 5 one sees that they are in the same direction. The camming up of any sphere 116 to 136 is completely independent of the octal digit previously stored thereon. The octal digit stored on any set disk 14 to 20 is easily determined by the computer since it is connected to read heads 24 to 30.

Initially all spheres 124 to 136 and locking ball 166 are cammed up. This occurs when shaft 114 has lock lobes 165 in the vertical position, FIGS. 9A to 9G. This occurs when shaft 114 is given two CW steps of 45 degrees each from that shown in FIG. 5. Each step hereinafter is considered to be a 45 degree rotation.

Once any particular sphere 124 to 136 is cammed up by CCW rotation of shaft 114, drive cylinder 140 must now be rotated CW to move any of set disks 14 to 20 and 170 and 172 which are locked onto drive cylinder 140 by the particular cammed up sphere into pocket 132.

All the spheres are cammed up when select shaft 114 has lock lobe 165 in the vertical direction 184. To unlock driver cylinder 140 from housing 152, and to unlock all spheres except 124, shaft 114 is given two CCW steps, see FIGS. 5 and 9A.

If one assumes that the vertical position of all set disks 14 to 20 is the reference direction for the octal digit stored thereon, one would have to step shaft 114 three times CW to place octal 0 in the vertical on set disk 14 in FIG. 5.

Figure 9A:
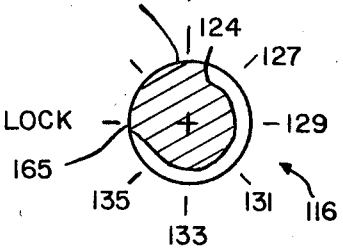
FIGS. 9A–9G illustrate by cross section different views of select shaft cams of the present invention.
Figure 9B:
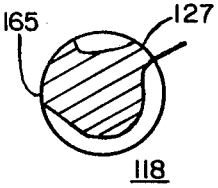
Figure 9C:
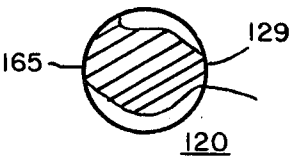
Figure 9D:
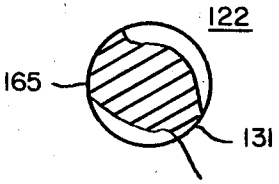
Figure 9E:
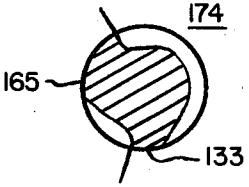
Figure 9F:
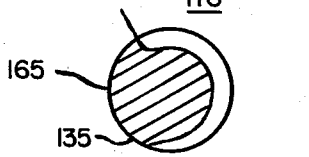
Figure 9G:
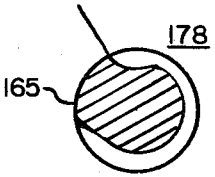

The maximum number of CW steps would be 7 to place an octal digit in the vertical 184 direction. After setting first set disk 14, shaft 114 is stepped once CCW. This de-cams sphere 124 from pocket 132 of disk 14 but then cams up sphere 126 with cam lobe 127 of cam 118. FIG. 9B, cam lobe 127 is one step from lobe 125. All spheres 124 to 136 and ball 16 are in a line on drive cylinder 140.

Shaft 114 is rotated CW the required number of steps to bring the second octal digit to the vertical 184 direction when ratchet drive 186 rotates drive cylinder 140 locked to second set disk 16. Once this has been accomplished, shaft 114 is again rotated CCW one step to de-cam sphere 126 and to cam up sphere 128 with cam lobe 129 FIG. 9C. The third octal digit is then set vertical by the required number of CW steps.

The above sequence is continued to load all four octal digits into memory section 12. The other set disks 170 and 172 can be used for other encoding information not of concern to the present inventive concept. After all set disks 14 to 20 and 170 and 172 have been loaded, shaft 114 makes one more CCW rotation which places lock lobe 165 under all spheres 124 to 136 and locking ball 166. Since ball 166 locks drive cylinder 140 to housing 152, all set disks are unable to rotate. Thus a hardened electromechanical switch 10 is produced.

In summary, one unlocks drive cylinder 140 by two CCW steps. By unlocking, first set disk 14 is locked onto driver cylinder 140. First set disk 14 is stepped CW until the appropriate first octal digit position is reached. First set disk 14 is unlocked and second set disk 16 is locked onto drive cylinder 114 by one CCW step. Second set disk 16 is stepped CW until the second octal digit position is reached. The above is repeated for third and fourth set disks 18 and 20 respectively. After the above, all set disks are locked onto drive cylinder 140 and the drive cylinder 140 is locked to the housing 152. Since the counter set disks 36 to 42 are directly geared to set disks 14 to 20, counter set disks 26 to 42 are thus located in appropriate octal digit positions.

In view of the above, a different counting base could be used by increasing the base but the reliability decreases primarily because the angle between each step must decrease. But other problems such as equipment complexity would make a higher base less appealing. Decreasing the number of the base would require that the number of set disks also increase to maintain the same number of combinations where there are $(B^N-1)$ combinations, B is the base and N is the number of set disks:

$$(8^4-1)=4095,\ (6^5-1)=7.775$$

Thus in reaching an optimum design one must balance complexity and reliability.

Clearly, many modifications and variations of the present invention are possible in light of the above teachings and it is therefore understood, that within the inventive scope of the inventive concept, the invention may be practiced otherwise than specifically claimed.

What is claimed is:

1. An electromechanical switch havinga hardened memory, said memory having a selectable multi-digit number of a given counting base stored therein, said switch electrically closing when a plurality of sequential switches close simultaneously after a predetermined length of time based upon said number stored therein, said electromechanical switch comprising:

counter means for producing a combination of unique electrical outputs, each of said outputs of said combination having a plurality of electrical pick-off positions, each output having one electrical pick-off, said electrical pick-off being brush means for transferring electrical signals, the number of said pick-off positions per output being equal to said given counting base used by said counter means, one of said positions per output being a selectable reference position, the number of unique electrical outputs in said combination being defined by $B^N$ where B is said counting base and N is the number of said outputs, said counter means sequencing through said combination, said counter means further comprising a mechanical counter having a plurality of stages, each of said stages having a counter wheel geared thereto, each of said counter wheels being co-axial, each of said counter wheels rotating in angular steps whereby the number of steps per rotation of said counter wheel in each of said stages is equal to said counting base, geneva means actuated by a motor drive to rotate said counter wheels, each of said counter wheels having fixedly attached about a circumference said electrical pick-off, a pick-off of a first stage of said plurality of stages electrically contacting an input trigger circuit being a first circuit of said electrical means, and a pick-off of a last stage of said plurality of stages being in intermittent electrical contact with said memory means;

memory means for holding one unique combination of electrical outputs, each of said outputs having an electrical contact fixed in one preselected position being one of a plurality of positions available, said memory means having a number of outputs at least equal to the number of outputs from said counter means, said plurality of positions available being equal to said counting base of said counter means, said one preselected position corresponding to one digit of said multi-digit number stored in said memory means, said plurality of sequential switches being at least equal to said number of outputs of said counter means, each sequential switch electrically closing when corresponding outputs of said counter means and said memory have said pick-off and said contact in electrical continuity as defined by said selectable reference position of said counter means and said preselected position of said memory means, said electromechanical switch producing an electrical output signal if and only if all of said sequential switches are in electrical continuity simultaneously;

said memory means further comprising:

set/lock means for loading and holding said multi-digit number into said memory means;

a stepper motor for actuating said set/lock means in response to signals received from said electrical means, said stepper motor being rotatable in both directions;

a plurality of set disks connected to said set/lock means, each of said set disks being independently rotatable and co-axially located on said set/lock means;

a plurality of counter set disks, each of said counter set disks being geared to said set disks and co-axially located, each of said counter set disks having fixedly located about a circumference an electrical contact, said counter set disks being co-axially located with said counter wheels of said counter means, the number of said counter set disks being equal to the number of said counter wheels, said counter set disks being alternately located between said counter wheels, each of said counter set disks being in continuous electrical contact with one of two of said adjacent counter wheels excepting a last counter set disk which is in continuous electrical contact with a second circuit of said electrical means, said last counter set disk being adjacent said pick-off of said last stage of said counter means, each of said counter set disks having fixedly located thereon an electrical contact, said electrical contact being intermittently in electrical contact with the other of two of said adjacent counter wheels, and reading means for reading digital data stored on said set disks, said digital data being communicated to a computer that controls the movement of said stepper motor through said electrical means, said stepper motor controlling said set/-lock means;

a housing for holding said counter means and said memory means;

electrical means for controlling said counter means and said memory means.

2. An electromechanical switch as defined in claim 1 wherein each of said set disks comprises:

a tube, said tube having a longitudinal cylindrical hole therethrough, said tube having a first end, said first end having longitudinally disposed on an external surface of said tube "V" shaped grooves, the number of said grooves being equal to said counting base, said tube having a second end, said second end having a geared flange fixedly attached to said external surface, said second end having a plurality of pockets circumferentially located about said cylindrical hole, said plurality of pockets being equal to said counting base of said number, said geared flange engaged to said counter set disks, said flange having encoded thereon data, said data being positioned about said flange in predefined positions equal in number to said counting base, each predefined position having a unique set of data, as each predefined position with said unique set of data thereon is located in said reading means, a position of said flange being determinable therefrom, said stepper motor being able to rotate said set disk to a position on said flange being a predetermined position.

3. An electromechanical switch as defined in claim 1 wherein said set/lock means comprises:

a detent means for engaging each of said set disks to prevent undesirable rotation;

a drive cylinder, said drive cylinder being tubular shaped, said cylinder closely fitting within said longitudinal cylindrical holes of said set disks, said drive cylinder having longitudinally located therein in a linear manner a plurality of holes perpendicular to a longitudinal axis of said drive cylinder, in each of said holes is a closely fitting sphere that is capable of radial motion, each sphere being seatable in each pocket of said set disks while remaining within said holes of said drive cylinder;

a pawl means, said pawl means allowing only one direction of rotation of said drive cylinder;

a select shaft, said shaft closely fitting within said drive cylinder, said shaft having a plurality of cams that act selectively upon each sphere located in said drive cylinder, when each of said spheres is cammed up, said set disk is locked onto said drive cylinder for rotation therewith;

a ratchet drive, said select shaft having about a circumference ratchet teeth, said drive cylinder having attached thereon a pawl that selectively engages said ratchet teeth, said driver cylinder being rotatable in one direction by said select shaft; and a stepper motor, said motor connected to said select shaft, said stepper motor stepping in response to a computer command based upon said multi-digit number to be stored in said memory means.

4. An electromechanical switch as defined in claim 3 wherein said multi-digit number has four numbers.

5. An electromechanical switch as defined in claim 4 wherein said multi-digit number is based upon octal.

6. An electromechanical switch as defined in claim 3 further including a means of locking said drive cylinder to said housing.

7. An electromechanical switch as defined in claim 6 wherein said means for locking includes a cam upon said select shaft, a locking ball being moved by said cam, a hole through said drive cylinder for closing holding said locking ball, and a housing pocket for seating said locking ball when cammed up by a lock lobe of said cam, said ball locking said drive cylinder to said housing when cammed up by said lock lobe thereon.

8. An electromechanical switch as defined in claim 7 wherein said select-shaft has a first cam, a vertical reference being defined as that cam position wherein a sphere on said first cam is cammed up into said pocket of a first set disk, when only said first set disk being locked onto said drive cylinder, said first cam having locking lobes, in a clockwise direction from said vertical position, at 270°, 315°, and 0°; a second cam having locking lobes at 45°, 270°, 315°; a third cam having locking lobes at 90°, 270° and 315°; a fourth cam having locking lobes at 135°, 270°, and 315°; a fifth cam having locking lobes at 180°, 270°, and 315°; a sixth cam having locking lobes at 225°, 270°, and 215°; and a seventh cam having locking lobes at 270° and 315°.

* * * * *